US006322485B1

(12) United States Patent
Marrero

(10) Patent No.: US 6,322,485 B1
(45) Date of Patent: Nov. 27, 2001

(54) PORTABLE ABDOMINAL EXERCISING MAT

(76) Inventor: Anthony Marrero, 685 S. Lucas Ave. #813, Los Angeles, CA (US) 90017

( * ) Notice: Subject to any disclaimer, the term of this patent is extended or adjusted under 35 U.S.C. 154(b) by 0 days.

(21) Appl. No.: 09/804,996

(22) Filed: Mar. 12, 2001

(51) Int. Cl.[7] ..... A63B 26/00; A63B 71/00

(52) U.S. Cl. ..... 482/140; 482/142; 206/315.1; 273/285; 273/286

(58) Field of Search ..... 482/140, 142; 52/660; 5/417; D06/582; 273/285, 286; 206/315.1

(56) References Cited

U.S. PATENT DOCUMENTS 3,773,328 * 11/1973 Seidman ..... 273/139
4,136,868 * 1/1979 Hogue ..... 272/144
4,666,042 * 5/1987 Dlott et al. ..... 206/542
4,712,673 * 12/1987 Moore ..... 206/232
5,417,636 * 5/1995 Havens ..... 482/145
5,454,125 * 10/1995 Ratkowski ..... 5/417
5,577,730 * 11/1996 Vannozzi, Sr. ..... 273/260
5,722,923 * 3/1998 Lui ..... 482/140
5,730,529 * 3/1998 Fritz et al. ..... 383/4
5,839,976 * 11/1998 Darr ..... 473/414

* cited by examiner

*Primary Examiner*—J. W. Donnelly
*Assistant Examiner*—Lori Baker Amerson
(74) *Attorney, Agent, or Firm*—Goldstein Law Offices, P.C.

(57) ABSTRACT

A portable abdominal exercising mat including a mat portion defined by an upper panel and a lower panel. The upper panel and the lower panel each have an inner surface, an outer surface, an upper edge, a lower edge, and opposed side edges. The lower edge of the upper panel and the upper edge of the lower panel are foldably coupled whereby the mat portion in an extended orientation has the opposed side edges of the upper and lower panels linearly aligned. The outer surface of the upper panel has a gaming board printed thereon.

7 Claims, 3 Drawing Sheets

PORTABLE ABDOMINAL EXERCISING MAT

BACKGROUND OF THE INVENTION

The present invention relates to a portable abdominal exercising mat and more particularly pertains to allowing the abdominal muscles to be properly exercised at any location.

In today's exercise crazed society, everyone is trying to gain an advantage in the production of exercise equipment. Long gone are the bulky, fixture-type exercise equipments, that all too often sit in a room, unused for weeks on weeks, gathering dust. Most people want exercise equipment that can be easily disassembled or folded up to store in a closet or underneath a bed. Even though this new type of exercise equipment can be concealed when not in use, it tends to be too heavy to tote around to places where exercise would be more convenient on a day-to-day basis. This is especially true for abdominal exercise devices. These devices are usually bulky and do not lend themselves to easy transport. What is needed is an abdominal exercise device that is portable for the "on the move" person.

The present invention attempts to solve the abovementioned problem by providing a device that allows a person to perform abdominal exercises, but is also portable.

The use of portable exercise devices is known in the prior art. More specifically, portable exercise devices heretofore devised and utilized for the purpose of facilitating exercise at a variety of locales are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,136,868 to Hogue discloses a slant board for exercising, comprised of foldable panels with a foot strap and a carrying handle. U.S. Pat. No. 5,417,636 to Havens discloses an exercise mat with a bar incorporated for holding a user's legs while performing sit ups. U.S. Pat. No. 5,722,923 to Lui discloses a folding abdominal muscle exercise device comprised of an upper and lower housing with means to adjust the positions of a hip, back and foot rest. U.S. Pat. No. 4,509,748 to Bezak discloses a portable exercise device capable of restraining a user's feet while performing sit-ups.

While these devices fulfill their respective, particular objective and requirements, the aforementioned patents do not describe a portable abdominal exercising mat for allowing the abdominal muscles to be properly exercised at any location.

In this respect, the portable abdominal exercising mat according to the present invention substantially departs from the conventional concepts and designs of the prior art, and in doing so provides an apparatus primarily developed for the purpose of allowing the abdominal muscles to be properly exercised at any location.

Therefore, it can be appreciated that there exists a continuing need for a new and improved portable abdominal exercising mat which can be used for allowing the abdominal muscles to be properly exercised at any location. In this regard, the present invention substantially fulfills this need.

SUMMARY OF THE INVENTION

In the view of the foregoing disadvantages inherent in the known types of portable exercise devices now present in the prior art, the present invention provides an improved portable abdominal exercising mat. As such, the general purpose of the present invention, which will be described subsequently in greater detail, is to provide a new and improved portable abdominal exercising mat which has all the advantages of the prior art and none of the disadvantages.

To attain this, the present invention essentially comprises a mat portion having a generally rectangular configuration. The mat portion is defined by an upper panel and a lower panel. The upper panel and the lower panel each have an inner surface, an outer surface, an upper edge, a lower edge, and opposed side edges. The lower edge of the upper panel and the upper edge of the lower panel are foldably coupled whereby the mat portion in an extended orientation has the opposed side edges of the upper and lower panels linearly aligned. The upper edge of the upper panel has a carrying handle secured thereto. The inner surface of the upper panel has a padded headrest disposed thereon inwardly of the upper edge thereof. The inner surface of the lower panel has a clock/timer positioned therein. The inner surface of the lower panel has a pair of adjustable foot straps secured thereto in a spaced relationship inwardly of the lower edge thereof. The foot straps each consist of an inflatable bladder having an incorporated air pump. The inner surface of the lower panel has a pair of assistance handles secured thereto inwardly of the opposed side edges thereof. The mat portion includes at least one angle adjustment bar that is adapted for coupling with the outer surfaces of the upper and lower panels. The outer surface of the lower panel has a gaming board printed thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable abdominal exercising mat which has all the advantages of the prior art portable exercise devices and none of the disadvantages.

It is another object of the present invention to provide a new and improved portable abdominal exercising mat which may be easily and efficiently manufactured and marketed.

It is a further object of the present invention to provide a new and improved portable abdominal exercising mat which of durable and reliable construction.

An even further object of the present invention is to provide a new and improved portable abdominal exercising mat which is susceptible of a low cost of manufacture with regard to both materials and labor, and which accordingly is then susceptible of low prices of sale to the consuming public, thereby making such a portable abdominal exercising mat economically available to the buying public.

Even still another object of the present invention is to provide a new and improved portable abdominal exercising mat for allowing the abdominal muscles to be properly exercised at any location.

Lastly, it is an object of the present invention to provide a new and improved portable abdominal exercising mat including a mat portion defined by an upper panel and a lower panel. The upper panel and the lower panel each have an inner surface, an outer surface, an upper edge, a lower edge, and opposed side edges. The lower edge of the upper panel and the upper edge of the lower panel are foldably coupled whereby the mat portion in an extended orientation has the opposed side edges of the upper and lower panels linearly aligned. The outer surface of the lower panel has a gaming board printed thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
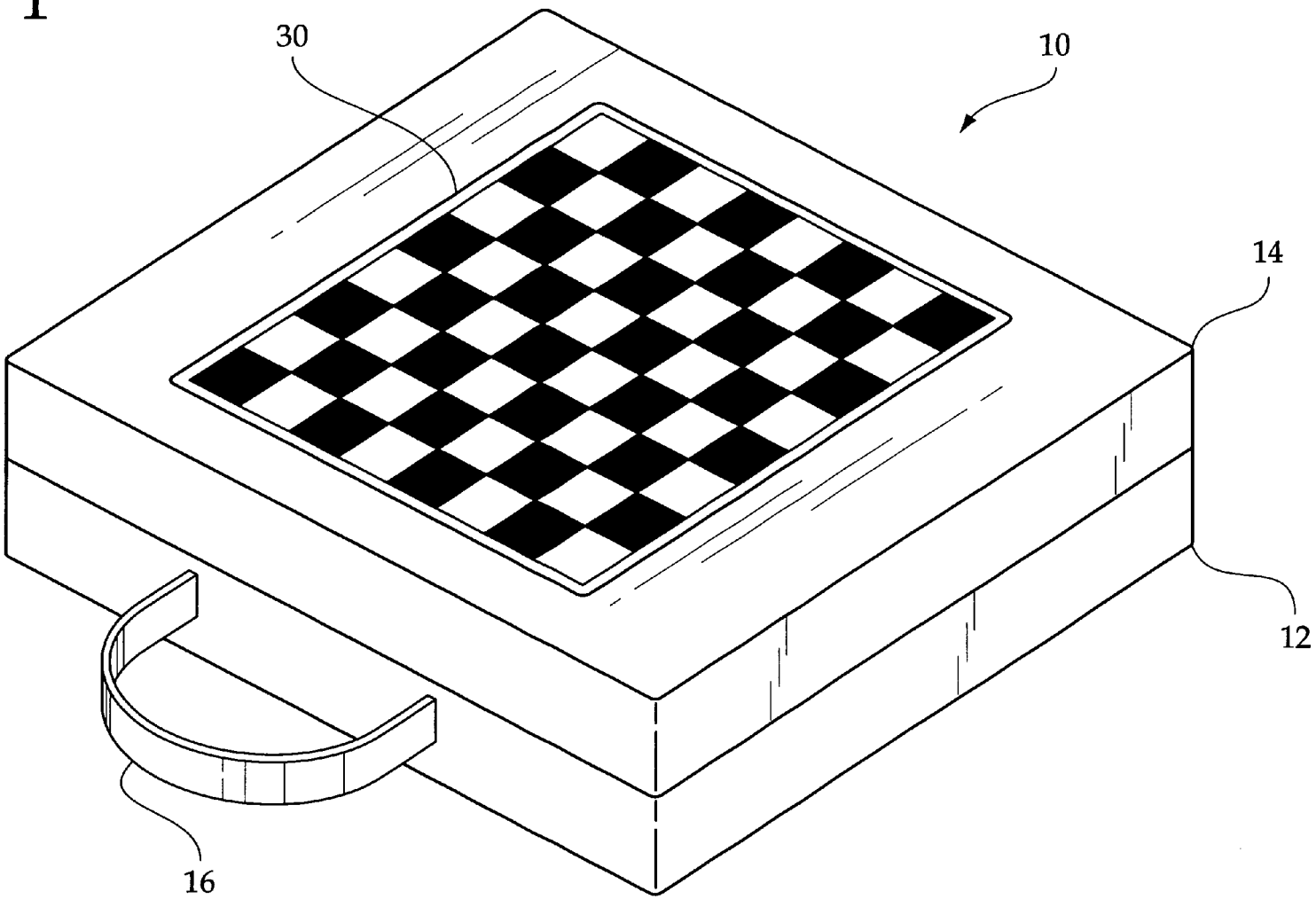
FIG. 1 is a perspective view of the preferred embodiment of the portable abdominal exercising mat constructed in accordance with the principles of the present invention.

With reference now to the drawings, and in particular, to FIGS. 1 through three thereof, the preferred embodiment of the new and improved portable abdominal exercising mat embodying the principles and concepts of the present invention and generally designated by the reference number 10 will be described.

Specifically, it will be noted in the various Figures that the device relates to a portable abdominal exercising mat for allowing the abdominal muscles to be properly exercised at any location.

Figure 2:
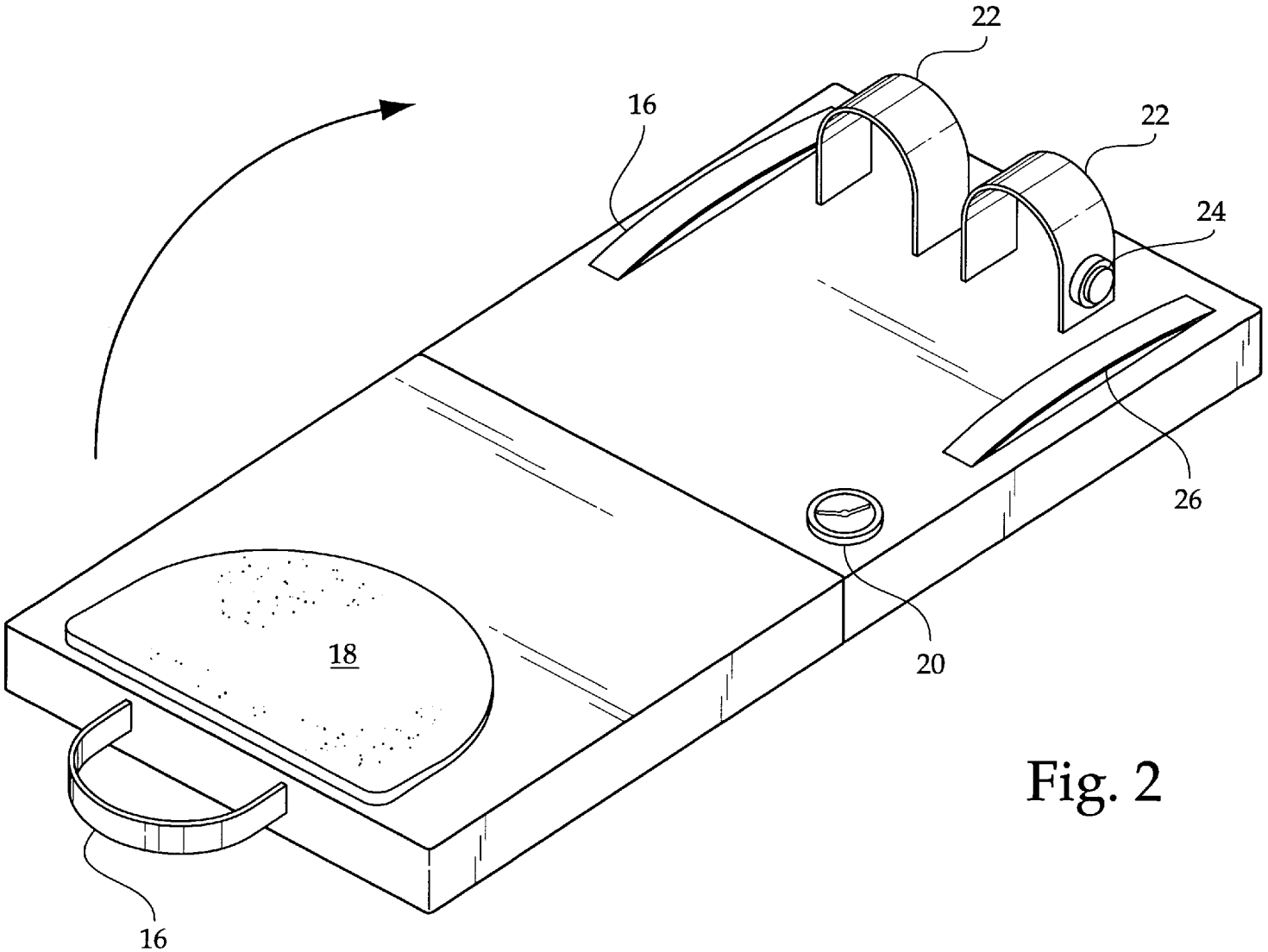
FIG. 2 is a perspective view of the present invention illustrated in an extended orientation.
Figure 3:
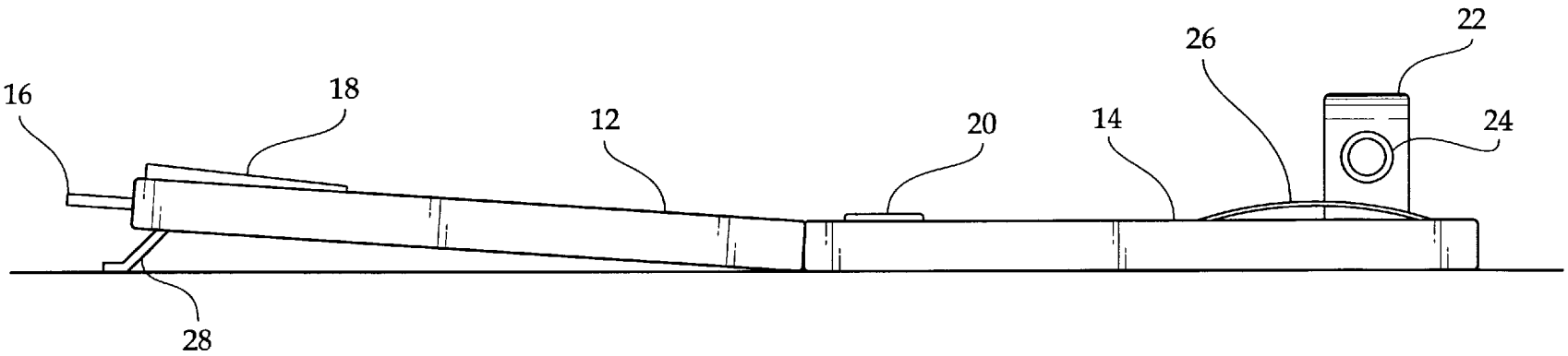
FIG. 3 is a side view of the present invention illustrated in the extended orientation.

The present invention is essentially comprised of a mat portion 10 having a plurality of components incorporated therein. The mat portion 10 along with these components attempt to make the performing of abdominal exercises a less arduous task. The mat portion 10 has a generally rectangular configuration. The mat portion 10 is defined by an upper panel 12 and a lower panel 14. The upper and lower panels 12,14 each has a square configuration and are of equal size and thickness. The panels 12,14 are constructed of a semi-rigid plastic. The upper panel 12 and the lower panel 14 each have an inner surface, an outer surface, an upper edge, a lower edge, and opposed side edges. The lower edge of the upper panel 12 and the upper edge of the lower panel 14 are foldably coupled whereby the mat portion 10 in an extended orientation has the opposed side edges of the upper and lower panels 12,14 linearly aligned. Note FIG. 2. The lower panel 14 can be folded atop the upper panel 12 in a closed orientation. Note FIG. 1. Some type of closure means would be included to prevent the mat portion 10 from inadvertently opening. Such closure means could be magnetic, hook and loop, or standard lock and key. The upper edge of the upper panel 12 has a carrying handle 16 secured thereto. The carrying handle 16 could be adjustable. The inner surface of the upper panel 12 has a padded headrest 18 disposed thereon inwardly of the upper edge thereof. The inner surface of the lower panel 14 has a clock/timer 20 positioned therein. The clock/timer 20 can be used to maintain a current time as well as the amount of time the user as he performs exercise. The inner surface of the lower panel 14 has a pair of adjustable foot straps 22 secured thereto in a spaced relationship inwardly of the lower edge thereof. The foot straps 22 each consists of an inflatable bladder having an incorporated air pump 24. Thus, the user will position his feet within the strap's 22 and then use the air pump 24 to fill the strap's 22 with air until the feet are comfortably engaged by the strap's 22. The inner surface of the lower panel 14 has a pair of assistance handles 26 secured thereto inwardly of the opposed side edges thereof. The assistance handles 26 will be positioned adjacent the strap's 22 to allow a beginner performing sit-ups the means to help them complete a repetition. The mat portion 10 includes at least one angle adjustment bar 28 that is adapted for coupling with the outer surfaces of the upper and lower panels 12,14. The angle adjustment bar 28, as noted in FIG. 3, can adjust the angle of the upper and lower panels 12,14 so that the user's head or feet can be raised. The outer surface of the lower panel 14 has a gaming board 30 printed thereon. The gaming board 30 could be used when the mat portion 10 is in the closed orientation. The selected gaming board, as illustrated in FIG. 1, is a checkerboard. Alternate gaming boards could also be substituted. Additionally, the present invention could also be provided with game pieces for use on the gaming board 30. Such game pieces as chess pieces or checkers are merely illustrative of the numerous possibilities available. Furthermore, the game board 30 could be fluorescent for use in dark conditions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable abdominal exercising mat for allowing the abdominal muscles to be properly exercised at any location comprising, in combination:

a mat portion having a generally rectangular configuration, the mat portion being defined by an upper panel and a lower panel, the upper panel and the lower panel each having an inner surface, an outer surface, an upper edge, a lower edge, and opposed side edges, the lower edge of the upper panel and the upper edge of the lower panel being foldably coupled whereby the mat portion in an extended orientation has the opposed side edges of the upper and lower panels being linearly aligned, the upper edge of the upper panel having a carrying handle secured thereto, the inner surface of the upper panel having a padded headrest disposed thereon inwardly of the upper edge thereof, the inner surface of the lower panel having a clock/timer positioned therein, the inner surface of the lower panel having a pair of adjustable foot straps secured thereto in a spaced relationship inwardly of the lower edge thereof, the foot straps each being comprised of an inflatable bladder having an incorporated air pump, the inner surface of the lower panel having a pair of assistance handles secured thereto inwardly of the opposed side edges thereof, the mat portion including at least one angle adjustment bar adapted for coupling with the outer surfaces of the upper and lower panels, the outer surface of the lower panel having a gaming board printed thereon.

2. A portable abdominal exercising mat for allowing the abdominal muscles to be properly exercised at any location comprising, in combination:

a mat portion defined by an upper panel and a lower panel, the upper panel and the lower panel each having an inner surface, an outer surface, an upper edge, a lower edge, and opposed side edges, the lower edge of the upper panel and the upper edge of the lower panel being foldably coupled whereby the mat portion in an extended orientation has the opposed side edges of the upper and lower panels being linearly aligned, the outer surface of the lower panel having a gaming board printed thereon, and the inner surface of the lower panel having a pair of adjustable foot straps secured thereto in a spaced relationship inwardly of the lower edge thereof, said straps each comprised of an inflated bladder having an incorporated air pump.

3. The portable abdominal exercising mat as set forth in claim two, wherein the upper edge of the upper panel has a carrying handle secured thereto.

4. The portable abdominal exercising mat as set forth in claim two, wherein the inner surface of the upper panel has a padded headrest disposed thereon inwardly of the upper edge thereof.

5. The portable abdominal exercising mat as set forth in claim two, wherein the inner surface of the lower panel has a clock/timer positioned therein.

6. The portable abdominal exercising mat as set forth in claim two, wherein the inner surface of the lower panel has a pair of assistance handles secured thereto inwardly of the opposed side edges thereof.

7. The portable abdominal exercising mat as set forth in claim two, wherein the mat portion includes at least one angle adjustment bar adapted for coupling with the outer surfaces of the upper and lower panels.

* * * * *